US006315389B1

(12) United States Patent
Torgerson et al.

(10) Patent No.: US 6,315,389 B1
(45) Date of Patent: Nov. 13, 2001

(54) PRINTHEAD HAVING DIFFERENT CENTER TO CENTER SPACINGS BETWEEN ROWS OF NOZZLES

(75) Inventors: Joseph M. Torgerson, Philomath; Angela White Bakkom; Mark H. MacKenzie, both of Corvallis, all of OR (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/548,708

(22) Filed: Apr. 13, 2000

(51) Int. Cl.[7] ..... B41J 2/145; B41J 2/15; B41J 2/05

(52) U.S. Cl. ..... 347/40; 347/65

(58) Field of Search ..... 347/40, 71, 74, 347/65

(56) References Cited

U.S. PATENT DOCUMENTS

| | | | | |
|---|---|---|---|---|
| 5,075,689 | * | 12/1991 | Hoisington et al. | 347/41 |
| 5,208,605 | | 5/1993 | Drake | 347/43 |
| 5,880,756 | * | 3/1999 | Ishii et al. | 347/40 |
| 5,946,012 | * | 8/1999 | Courian et al. | 347/63 |

FOREIGN PATENT DOCUMENTS 61-104856 5/1986 (JP) .

* cited by examiner

*Primary Examiner*—Thinh Nguyen
(74) *Attorney, Agent, or Firm*—Manuel Quiogue

(57) ABSTRACT

An ink jet printhead having a plurality of columnar arrays of ink drop generators that have different center to center spacing along a reference axis. The ink jet printhead further includes ink feed slots that are each fluidically connected to only one columnar array of ink drop generators.

11 Claims, 6 Drawing Sheets

PRINTHEAD HAVING DIFFERENT CENTER TO CENTER SPACINGS BETWEEN ROWS OF NOZZLES

BACKGROUND OF THE INVENTION

The subject invention generally relates to ink jet printing, and more particularly to a thin film ink jet printhead having ink drop generators of different print resolution.

The art of ink jet printing is relatively well developed. Commercial products such as computer printers, graphics plotters, and facsimile machines have been implemented with ink jet technology for producing printed media. The contributions of Hewlett-Packard Company to ink jet technology are described, for example, in various articles in the *Hewlett-Packard Journal,* Vol. 36, No. 5 (May 1985); Vol. 39, No. 5 (October 1988); Vol. 43, No. 4 (August 1992); Vol. 43, No. 6 (December 1992); and Vol. 45, No. 1 (February 1994); all incorporated herein by reference.

Generally, an ink jet image is formed pursuant to precise placement on a print medium of ink drops emitted by an ink drop generating device known as an ink jet printhead. Typically, an ink jet printhead is supported on a movable print carriage that traverses over the surface of the print medium and is controlled to eject drops of ink at appropriate times pursuant to command of a microcomputer or other controller, wherein the timing of the application of the ink drops is intended to correspond to a pattern of pixels of the image being printed.

A typical Hewlett-Packard ink jet printhead includes an array of precisely formed nozzles in an orifice plate that is attached to an ink barrier layer which in turn is attached to a thin film substructure that implements ink firing heater resistors and apparatus for enabling the resistors. The ink barrier layer defines ink channels including ink chambers disposed over associated ink firing resistors, and the nozzles in the orifice plate are aligned with associated ink chambers. Ink drop generator regions are formed by the ink chambers and portions of the thin film substructure and the orifice plate that are adjacent the ink chambers.

The thin film substructure is typically comprised of a substrate such as silicon on which are formed various thin film layers that form thin film ink firing resistors, apparatus for enabling the resistors, and also interconnections to bonding pads that are provided for external electrical connections to the printhead. The ink barrier layer is typically a polymer material that is laminated as a dry film to the thin film substructure, and is designed to be photodefinable and both UV and thermally curable. In an ink jet printhead of a slot feed design, ink is fed from one or more ink reservoirs to the various ink chambers through one or more ink feed slots formed in the substrate.

An example of the physical arrangement of the orifice plate, ink barrier layer, and thin film substructure is illustrated at page 44 of the *Hewlett-Packard Journal* of February 1994, cited above. Further examples of ink jet printheads are set forth in commonly assigned U.S. Pat. Nos. 4,719,477 and 5,317,346, both of which are incorporated herein by reference.

Considerations with thin film ink jet printheads include increased substrate size and/or substrate fragility as more ink drop generators and/or ink feed slots are employed. There is accordingly a need for an improved ink jet printhead that is compact and has a large number of ink drop generators.

SUMMARY OF THE INVENTION

The disclosed invention is directed to an ink jet printhead that includes a printhead substrate, a first plurality of ink drop generators formed in the substrate and having a first predetermined center to center spacing along a reference axis, and a second plurality of ink drop generators formed in the printhead substrate and having a second predetermined center to center spacing along the reference axis.

BRIEF DESCRIPTION OF THE DRAWINGS

The advantages and features of the disclosed invention will readily be appreciated by persons skilled in the art from the following detailed description when read in conjunction with the drawing wherein.

DETAILED DESCRIPTION OF THE DISCLOSURE

Figure 1:
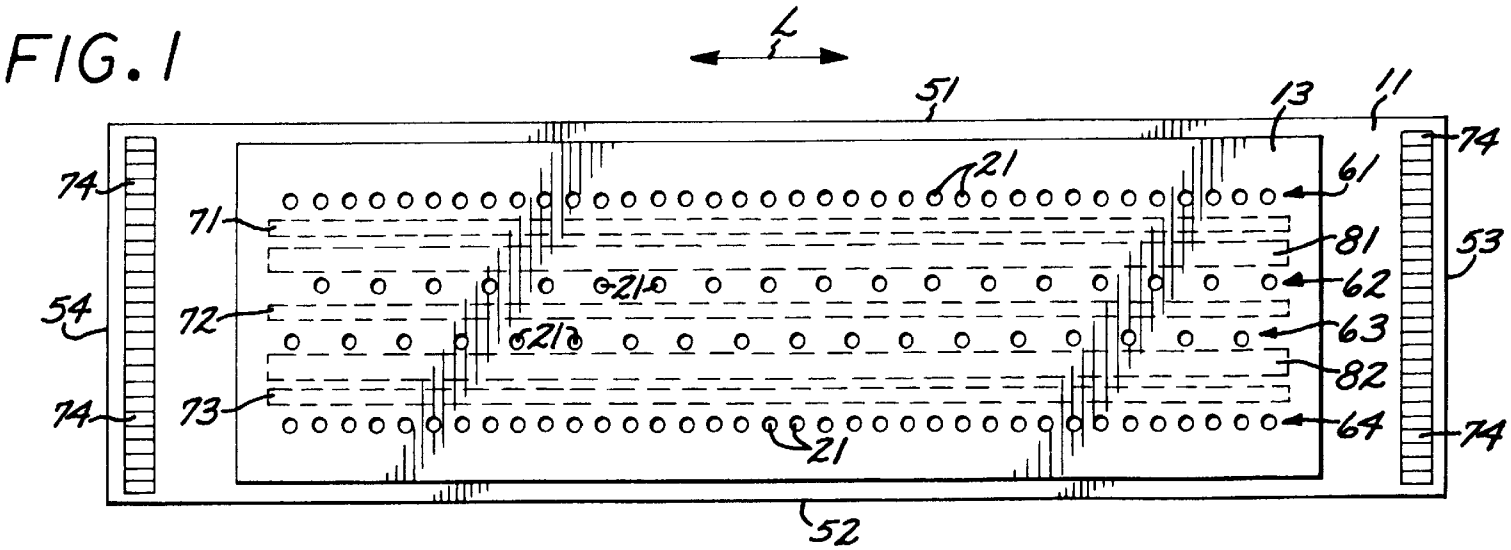
FIG. 1 is an unscaled schematic top plan illustration of the layout of an ink jet printhead that employs the invention.

In the following detailed description and in the several figures of the drawing, like elements are identified with like reference numerals.

Figure 2:
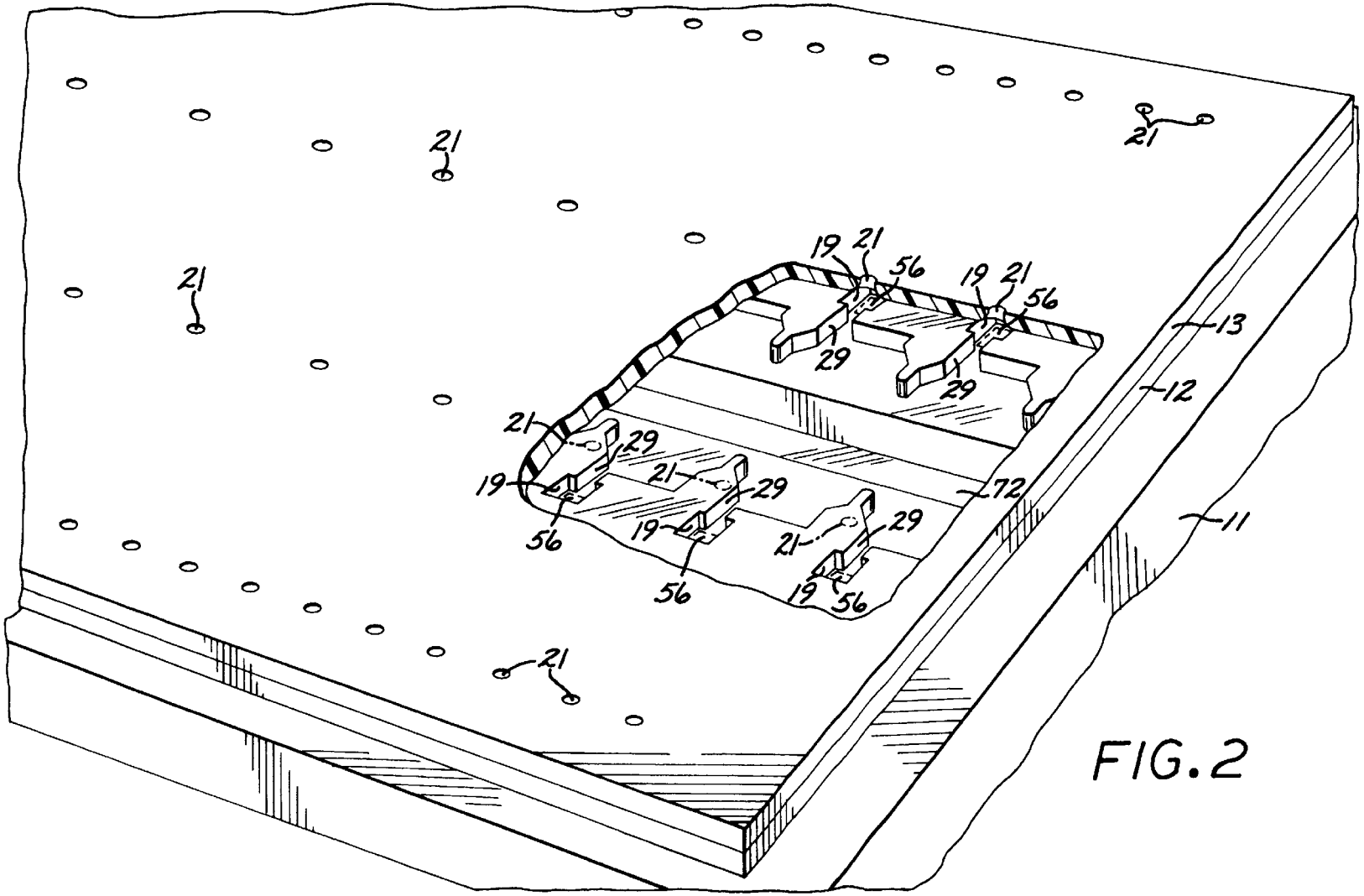
FIG. 2 is a schematic, partially broken away perspective view of the ink jet printhead of FIG. 1.

Referring now to FIGS. 1 and 2, schematically illustrated therein is an unscaled schematic perspective view of an ink jet printhead in which the invention can be employed and which generally includes (a) a thin film substructure or die 11 comprising a substrate such as silicon and having various thin film layers formed thereon, (b) an ink barrier layer 12 disposed on the thin film substructure 11, and (c) an orifice or nozzle plate 13 laminarly attached to the top of the ink barrier 12.

The thin film substructure 11 is formed pursuant to conventional integrated circuit techniques, and includes thin film heater resistors 56 formed therein. The ink barrier layer 12 is formed of a dry film that is heat and pressure laminated to the thin film substructure 11 and photodefined to form therein ink chambers 19 and ink channels 29 which are disposed over resistor regions in which the heater resistors are formed. Gold bonding pads 74 engagable for external electrical connections are disposed at the ends of the thin film substructure 11 and are not covered by the ink barrier layer 12. By way of illustrative example, the barrier layer material comprises an acrylate based photopolymer dry film such as the "Parad" brand photopolymer dry film obtainable from E. I. duPont de Nemours and Company of Wilmington, Del. Similar dry films include other duPont products such as the "Riston" brand dry film and dry films made by other chemical providers. The orifice plate 13 comprises, for example, a planar substrate comprised of a polymer material and in which the orifices are formed by laser ablation, for example as disclosed in commonly assigned U.S. Pat. No. 5,469,199, incorporated herein by reference. The orifice plate can also comprise a plated metal such as nickel.

Figure 3:
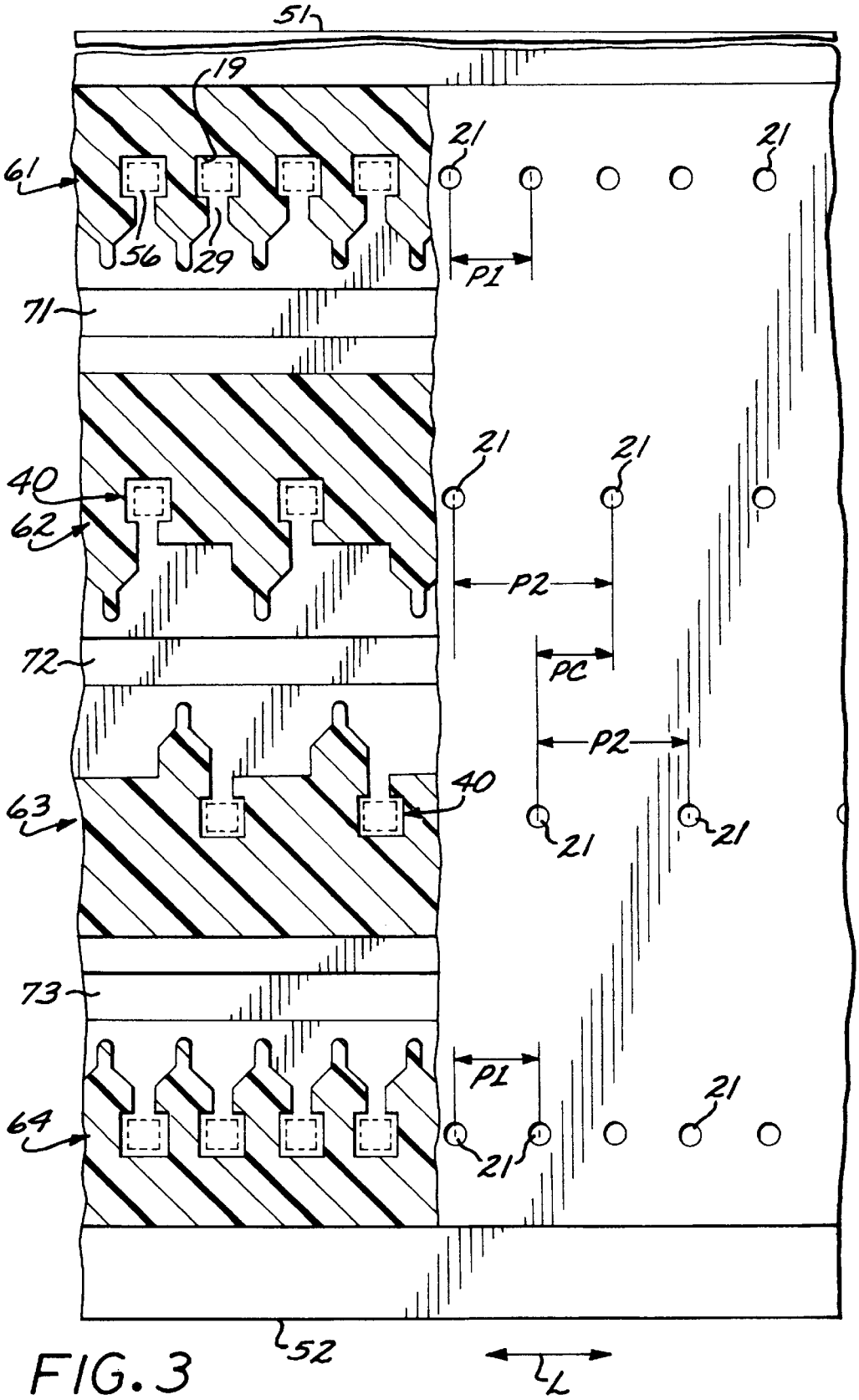
FIG. 3 is an unscaled schematic partial top plan illustration of the ink jet printhead of FIG. 1.

As depicted in FIG. 3, the ink chambers 19 in the ink barrier layer 12 are more particularly disposed over respective ink firing resistors 56, and each ink chamber 19 is defined by interconnected edges or walls of a chamber opening formed in the barrier layer 12. The ink channels 29 are defined by further openings formed in the barrier layer 12, and are integrally joined to respective ink firing chambers 19. FIGS. 1, 2 and 3 illustrate by way of example a slot fed ink jet printhead wherein the ink channels open towards an edge formed by an ink feed slot in the thin film substructure, whereby the edge of the ink feed slot forms a feed edge.

The orifice plate 13 includes orifices or nozzles 21 disposed over respective ink chambers 19, such that each ink firing resistor 56, an associated ink chamber 19, and an associated orifice 21 are aligned and form an ink drop generator 40.

While the disclosed printhead has been described as having a barrier layer and a separate orifice plate, it should be appreciated that the invention can be implemented in printheads having an integral barrier/orifice structure that can be made using a single photopolymer layer that is exposed with a multiple exposure process and then developed.

The ink drop generators 40 are arranged in four columnar arrays or groups 61, 62, 63, 64 that are spaced apart from each other transversely relative to a reference axis L. The heater resistors 56 of each ink drop generator group are generally aligned with the reference axis L and have a predetermined center to center spacing or nozzle pitch (P1 or P2, as described further herein) along the reference axis L. Two ink drop generator groups 61, 64 are respectively located adjacent opposite edges 51, 52 of the thin film substructure 11 while two ink drop generator groups 62, 63 are located in the middle portion of the thin film substructure, such that the two ink drop generator groups 62, 63 are between and inboard of the ink drop generator groups 61, 64 which are outboard groups. By way of illustrative example, the thin film substructure is rectangular and opposite edges 51, 52 thereof are longitudinal edges of the length dimension while opposite edges 53, 54 are of the width dimension which is less than the length dimension of the printhead. The longitudinal edges 51, 52 can be parallel to the reference axis L. In use, the reference axis L can be aligned with what is generally referred to as the media advance axis.

While the ink drop generators 40 of each ink drop generator group are illustrated as being substantially collinear, it should be appreciated that some of the ink drop generators 40 of an ink drop generator group can be slightly off the center line of the column, for example to compensate for firing delays.

Insofar as each of the ink drop generators 40 includes a heater resistor 56, the heater resistors are accordingly arranged in groups or arrays that correspond to the ink drop generators. For convenience, the heater resistor arrays or groups will be referred to by the same reference numbers 61, 62, 63, 64.

The ink drop generators 40 of the outboard group 61 that is adjacent the longitudinal edge 51 of the thin film substructure 11 have a center to center spacing (or nozzle pitch) P1 along the reference axis, and the ink drop generators 40 of the outboard group 64 that is adjacent the longitudinal edge 52 also have the center to center spacing P1. The ink drop generators 40 of the inboard group 62 have a center to center spacing P2 along the reference axis that is different than the center to center spacing P1, and the ink drop generators 40 of the inboard group 63 also have the center to center spacing P2. In other words, ink drop generators 40 of each of the outboard groups 61, 64 are spaced closer or further to each other within the group along the reference axis L than the ink generators 40 of each of the inboard groups 62, 63.

By way of illustrative example, the center to center spacing P2 is twice the center to center spacing P1, and the ink drop generators 40 of the inboard group 62 are staggered along the reference axis relative to the ink drop generators 40 of the inboard group 63 such that a combined center to center spacing PC of the ink drop generators of the inboard groups 62, 63 is substantially equal to the center to center spacing P1. More generally, the center to center spacing P2 of ink drop generators 40 of each of the inboard groups 62, 63 can be selected such that the composite center to center spacing PC, along the reference axis L, of the combination of the inboard groups 62, 63 is an integral multiple of the center to center or nozzle spacing P1 of each of the outboard groups 61, 64.

Figure 4:
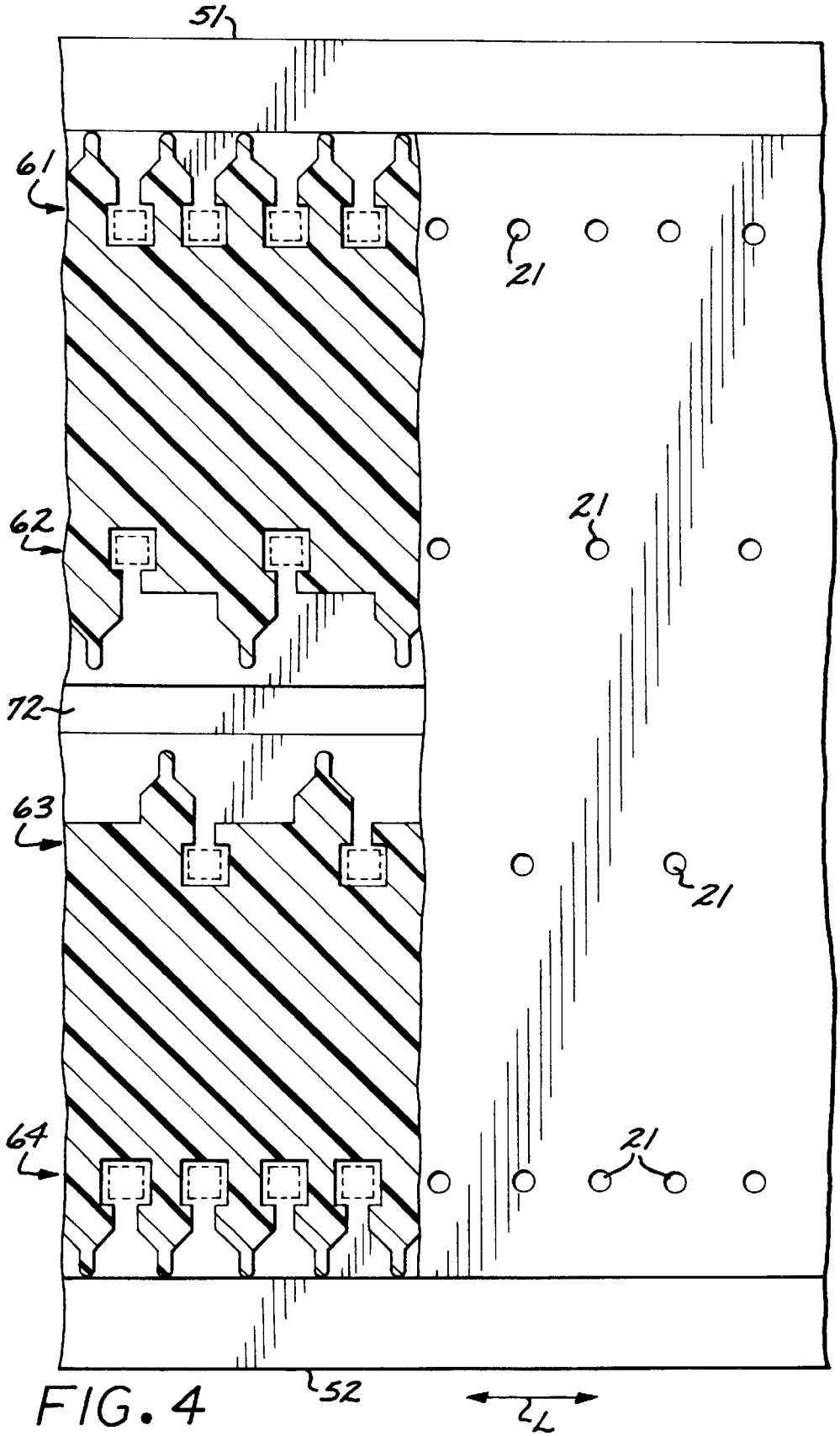
FIG. 4 is an unscaled schematic partial top plan view of another ink jet printhead that employs the invention.

The foregoing arrangement of ink drop generators can be implemented in an exclusively slot fed printhead, as shown in FIGS. 1, 2 and 3, or an edge fed and slot fed printhead, as shown in FIG. 4. More particularly, the inboard ink drop generator groups 62, 63 receive ink from the same ink feed slot 72 and thus produce ink drops of the same color, while the outboard groups 61, 64 receive ink from either different slots 71, 73 or different outside edges 51, 52 such that the outboard ink drop generator groups 61, 64 can respectively produce ink drops of respectively different colors or the same color. By way of illustrative example, to the extent that, in the manufacture of the printhead, the placement and/or alignment of the ink drop generators 40 of the inboard groups 62, 63 is not as precise as the placement and/or alignment of the ink drop generators of the outboard groups 61, 64, the ink drop generators 40 of the inboard groups 62, 63 can be configured to produce drops of a color having a greater dot size threshold of visual acuity, such as yellow in a cyan, yellow, magenta color system. In this manner, since dot placement errors of yellow dot is less noticeable, yellow dots are produced by ink drop generators that tend to produce greater dot placement errors.

The thin film substructure 11 of the printhead of FIGS. 1, 2 and 3 more particularly includes ink feed slots 71, 72, 73 that are aligned with the reference axis L, and are spaced apart from each other transversely relative to a reference axis L. The ink feed slot 72 is located between the inboard ink drop generator groups 62, 63 and feeds ink to those ink drop generator groups, while the ink feed slots 71, 73 are respectively located inboard of the outboard ink drop generator group 61 and the outboard ink drop generator group 64, and respectively provide ink only to the ink drop generators 40 of an adjacent outboard ink drop generator group. More particularly, the ink feed slot 71 is located between the outboard ink drop generator group 61 and the inboard ink drop generator group 62, but is fluidically coupled only to the outboard ink drop generator group 61 that is adjacent the edge 51 of the thin film substructure. Similarly, the ink feed slot 73 is located between the outboard ink drop generator group 64 and the inboard ink drop generator group 63, but is fluidically coupled only to the ink drop generator group 64 that is adjacent the edge 52 of the thin film substructure 11. In other words, the ink feed slot 72 is a double-edge or double-side feeding ink slot, while each of the outboard ink feed slots 71, 73 is a single-edge or single-side feeding ink slot.

The thin film substructure 11 further includes a first circuit region 81 disposed between a laterally outermost ink feed slot 71 and the inboard ink drop generator group 62, and a second circuit region 82 disposed between the other laterally outermost ink feed slot 73 and the inboard ink drop generator group 63. The first circuit region 81 is available for drive circuitry (e.g., drive transistors and/or interconnect lines) for the inboard ink drop generator group 62, while the second circuit region 82 is available for drive circuitry for the in board ink drop generator group 63.

Referring now to FIG. 4, the above described layout of the ink drop generators 40 can be implemented in an edge fed and slot fed printhead, wherein the ink channels 19 that lead into the outboard ink generator groups 61, 64 open towards the longitudinal edges 51, 52 of the thin film substrate 11. Examples of edge fed printheads are disclosed in commonly assigned U.S. Pat. Nos. 5,604,519; 5,638,101; and 3,568, 171, incorporated herein by reference. The inboard ink drop generator groups 62, 63 receive ink from an ink feed slot 72 located between the inboard groups 62, 63.

Figure 5:
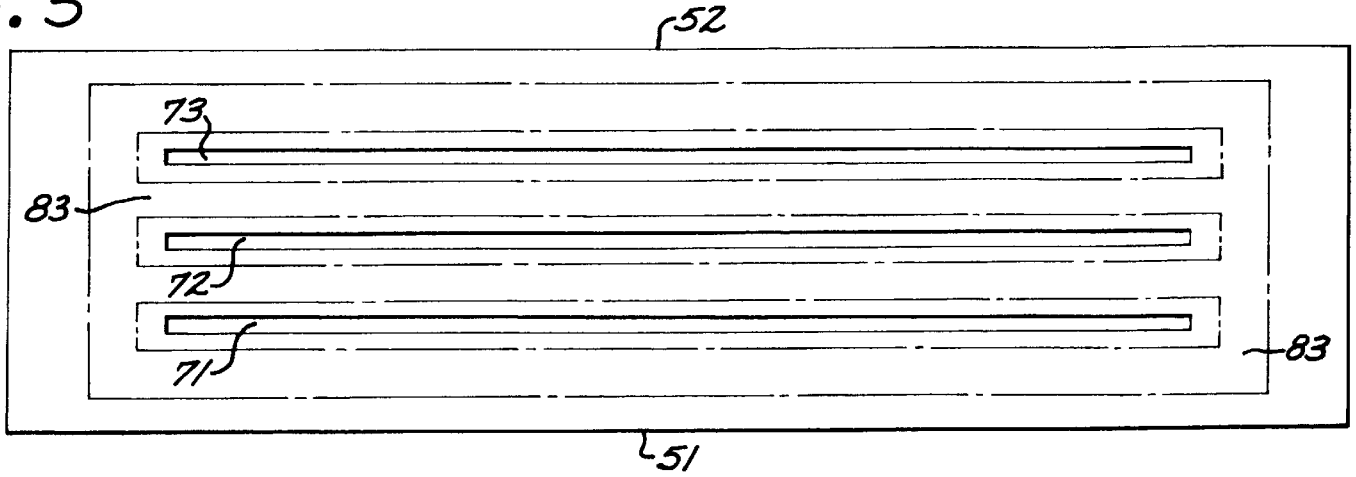
FIG. 5 is an unscaled schematic bottom plan view of the thin film substructure of the ink jet printhead of FIG. 1 illustrating adhesive contact areas.
Figure 6:
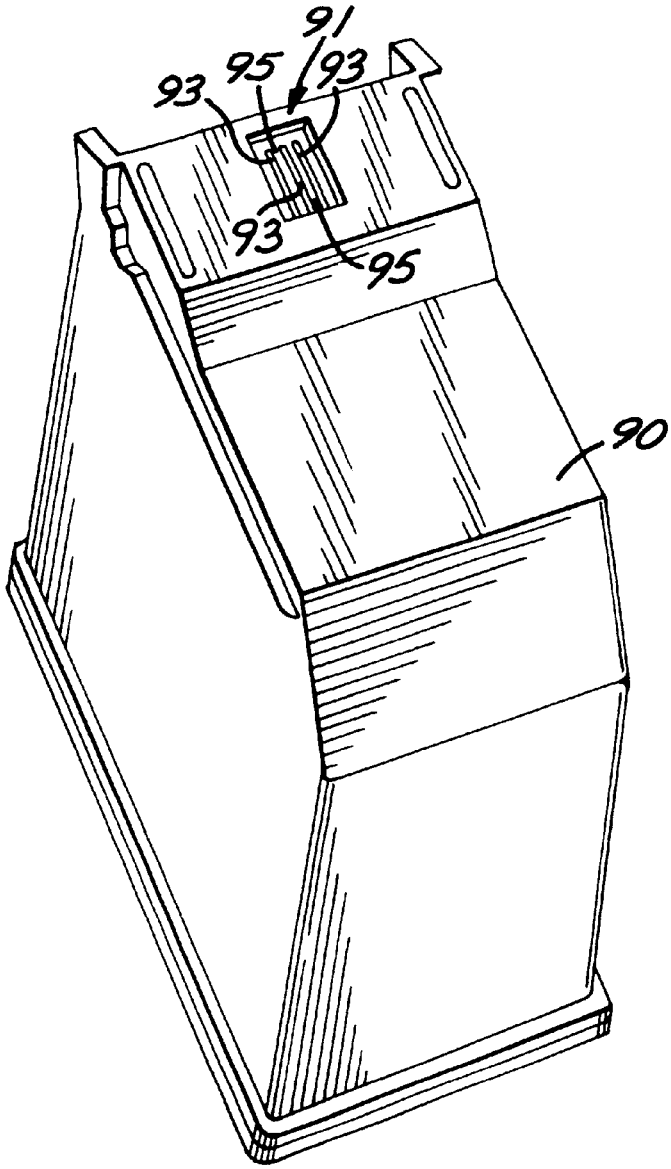
FIG. 6 is an unscaled schematic illustration of a print cartridge that includes a headland area to which the ink jet printhead of FIG. 1 or FIG. 3 can be attached.

The disclosed layout of ink drop generators of an ink jet printhead and the layout of ink feed slots of an ink jet printhead advantageously avoid thin film substrate fragility and provide for a strong compact thin film substructure in view of structure between the edges of the thin film substructure and the slots 71, 73, as well as structure between the slots 71, 72, 73. Referring more particularly to FIG. 5, the layout of the thin film substructure 11 further provides for an optimal interface area 83 on the lower side of the thin film substructure 11 for attaching the printhead to a headland area 91 of a print cartridge body 90 (FIG. 6). The interface area 83 more particularly is an area on the lower side of the thin film substructure 11 that can be contacted by an adhesive that is utilized to attach the printhead to a headland area 91 of a print cartridge body 90. The interface area 83 more particularly comprises side by side elongated closed loops that respectively surround openings of the slots 71, 72, 73 on the lower surface of the thin film substructure 11. The headland area 91 of the print cartridge 90 more particularly includes flanges 95 that surround ink slots 93 and match the interface pattern 83 on the lower side of the thin film substructure and are adhesively attached to the lower side of the thin film substructure. For example, an adhesive bead is formed on the flanges 95 of the headland are 91 and the printhead is then pressed onto the headland 91 with the interface pattern 83 in alignment with the flanges 95 of the headland. In this manner, the ink slots in cartridge body 90, the adhesive, and the ink feed slots in the printhead effectively form respective conduits for transporting ink from reservoirs in the print cartridge body 90 to the ink channels of the ink jet printhead.

Figure 7:
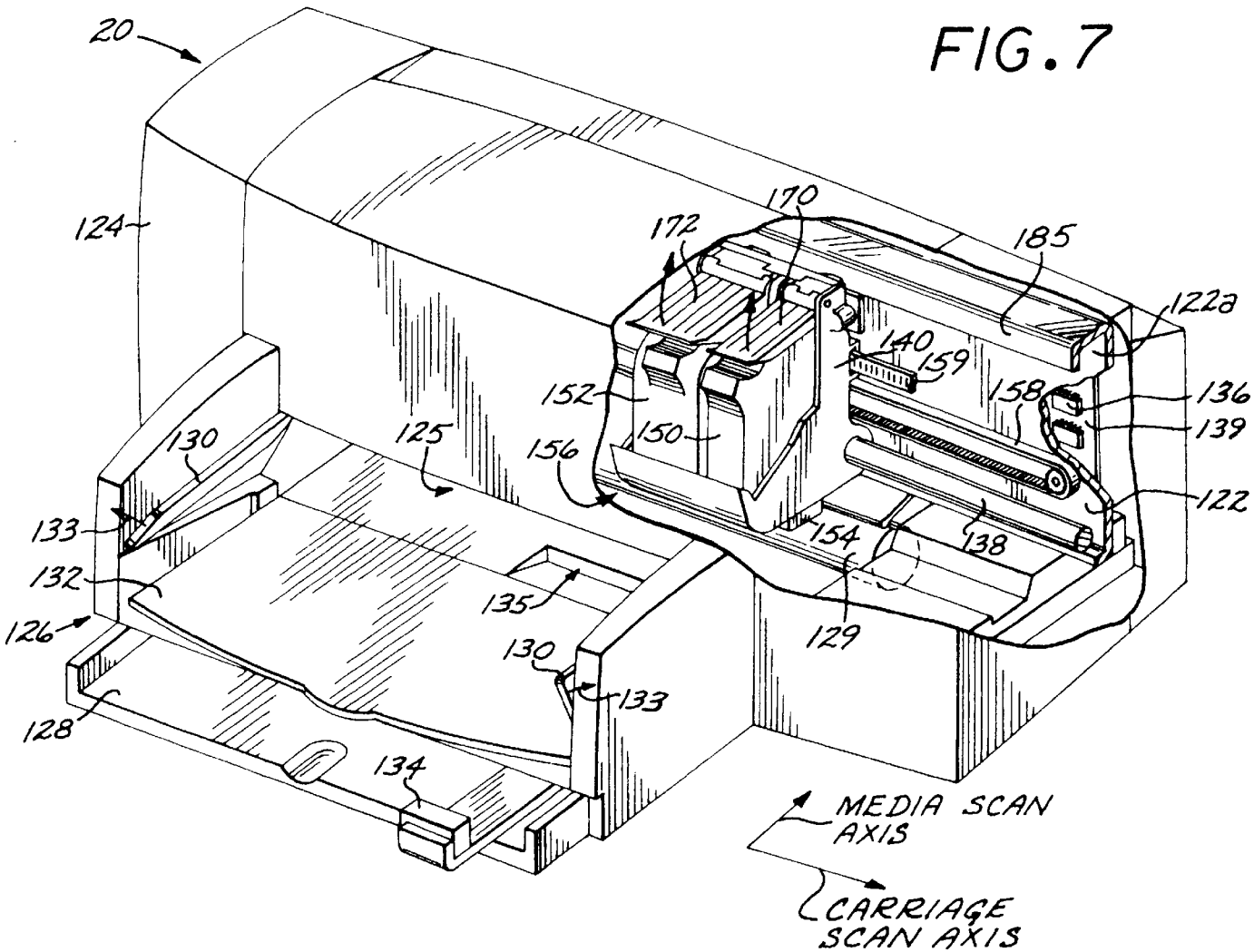
FIG. 7 is an unscaled schematic perspective view of a printer in which the printhead of the invention can be employed.

Referring now to FIG. 7, set forth therein is a schematic perspective view of an example of an ink jet printing device 110 in which the above described printheads can be employed. The ink jet printing device 110 of FIG. 7 includes a chassis 122 surrounded by a housing or enclosure 124, typically of a molded plastic material. The chassis 122 is formed for example of sheet metal and includes a vertical panel 122*a*. Sheets of print media are individually fed through a print zone 125 by an adaptive print media handling system 126 that includes a feed tray 128 for storing print media before printing. The print media may be any type of suitable printable sheet material such as paper, card-stock, transparencies, Mylar, and the like, but for convenience the illustrated embodiments described as using paper as the print medium. A series of conventional motor-driven rollers including a drive roller 129 driven by a stepper motor may be used to move print media from the feed tray 128 into the print zone 125. After printing, the drive roller 129 drives the printed sheet onto a pair of retractable output drying wing members 130 which are shown extended to receive a printed sheet. The wing members 130 hold the newly printed sheet for a short time above any previously printed sheets still drying in an output tray 132 before pivotally retracting to the sides, as shown by curved arrows 133, to drop the newly printed sheet into the output tray 132. The print media handling system may include a series of adjustment mechanisms for accommodating different sizes of print media, including letter, legal, A-4, envelopes, etc., such as a sliding length adjustment arm 134 and an envelope feed slot 135.

The printer of FIG. 7 further includes a printer controller 136, schematically illustrated as a microprocessor, disposed on a printed circuit board 139 supported on the rear side of the chassis vertical panel 122*a*. The printer controller 136 receives instructions from a host device such as a personal computer (not shown) and controls the operation of the printer including advance of print media through the print zone 125, movement of a print carriage 140, and application of signals to the ink drop generators 40.

A print carriage slider rod 138 having a longitudinal axis parallel to a carriage scan axis is supported by the chassis 122 to sizeably support a print carriage 140 for reciprocating transnational movement or scanning along the carriage scan axis. The print carriage 140 supports first and second removable ink jet printhead cartridges 150, 152 (each of which is sometimes called a "pen," "print cartridge," or "cartridge"). The print cartridges 150, 152 include respective printheads 154, 156 that respectively have generally downwardly facing nozzles for ejecting ink generally downwardly onto a portion of the print media that is in the print zone 125. The print cartridges 150, 152 are more particularly clamped in the print carriage 140 by a latch mechanism that includes clamping levers, latch members or lids 170, 172.

An illustrative example of a suitable print carriage is disclosed in commonly assigned U.S. application Ser. No. 08/757,009, filed Nov. 26, 1996, Harmon et al., incorporated herein by reference.

For reference, print media is advanced through the print zone 125 along a media axis which is parallel to the tangent to the portion of the print media that is beneath and traversed by the nozzles of the cartridges 150, 152. If the media axis and the carriage axis are located on the same plane, as shown in FIG. 7, they would be perpendicular to each other.

An anti-rotation mechanism on the back of the print carriage engages a horizontally disposed anti-pivot bar 185 that is formed integrally with the vertical panel 122*a* of the chassis 122, for example, to prevent forward pivoting of the print carriage 140 about the slider rod 138.

By way of illustrative example, the print cartridge 150 is a monochrome printing cartridge while the print cartridge 152 is a tri-color printing cartridge that employs a printhead in accordance with the teachings herein.

The print carriage 140 is driven along the slider rod 138 by an endless belt 158 which can be driven in a conventional manner, and a linear encoder strip 159 is utilized to detect position of the print carriage 140 along the carriage scan axis, for example in accordance with conventional techniques.

Although the foregoing has been a description and illustration of specific embodiments of the invention, various modifications and changes thereto can be made by persons skilled in the art without departing from the scope and spirit of the invention as defined by the following claims.

What is claimed is:

1. An ink jet printing apparatus comprising:

a printhead substrate including a plurality of thin film layers and having a first edge and a second edge opposite said first edge;

a first plurality of ink drop generators defined in said printhead substrate adjacent said first edge and having a first predetermined center to center spacing along a reference axis;

a second plurality of ink drop generators defined in said printhead substrate adjacent said second edge and spaced laterally, relative to the reference axis, from said first plurality of ink drop generators, said second plurality of ink drop generators having said first predetermined center to center spacing;

a third plurality of ink drop generators defined in said printhead substrate and having a second predetermined center to center spacing along said reference axis that is greater than said first predetermined center to center spacing;

a fourth plurality of ink drop generators defined in said printhead substrate and spaced laterally, relative to said reference axis, from said third plurality of ink drop generators, said fourth plurality of ink drop generators having said second predetermined center to center spacing along said reference axis; and wherein said third plurality of ink drop generators and said fourth plurality of ink drop generators are located between said first plurality of ink drop generators and said second plurality of ink drop generators.

2. The ink jet printing apparatus of claim 1 further including an ink feed slot aligned with said reference axis, and wherein said third plurality of ink drop generators are on one side of said ink feed slot and wherein said fourth plurality of ink drop generators are on another side of said ink feed slot.

3. The ink jet printing apparatus of claim 1 wherein said fourth plurality of ink drop generators are staggered relative to said third plurality of ink drop generators along said reference axis such that said third plurality of ink drop generators and said fourth plurality of ink drop generators have a combined center to center spacing along said reference axis that is substantially equal to said first predetermined center to center spacing.

4. The ink jet printing apparatus of claim 1 wherein said third plurality of ink drop generators and said fourth plurality of ink drop generators produce yellow ink drops.

5. An ink jet printing apparatus comprising:

a printhead structure formed of a substrate, a plurality of thin film layers, an ink barrier layer and a plurality of nozzles;

a first plurality of ink drop generators defined in said printhead structure adjacent an edge of said printhead substrate and having a first predetermined center to center spacing along a reference axis;

an ink feed slot in said substrate aligned with said reference axis;

a second plurality of ink drop generators defined in said printhead structure adjacent one side of said ink feed slot and having a second predetermined center to center spacing along said reference axis that is greater than said first predetermined center to center spacing;

a third plurality of ink drop generators defined in said printhead substrate adjacent another side of said ink feed slot that is opposite said one side and spaced laterally, relative to said reference axis, from said second plurality of ink drop generators, said third plurality of ink drop generators having said second predetermined center to center spacing along said reference axis;

wherein said first plurality of ink drop generators is between said edge and said second plurality of ink drop generators; and wherein said second plurality of drop generators and said third plurality of drop generators produce yellow ink drops.

6. An ink jet printing apparatus comprising:

a printhead structure formed of a substrate, a plurality of thin film layers, an ink barrier layer and a plurality of nozzles;

a first plurality of ink drop generators defined in said printhead structure adjacent an edge of said printhead substrate and having a first predetermined center to center spacing along a reference axis;

an ink feed slot in said substrate aligned with said reference axis;

a second plurality of ink drop generators defined in said printhead structure on one side of said ink feed slot and having a second predetermined center to center spacing along said reference axis that is greater than said first predetermined center to center spacing;

a third plurality of ink drop generators defined in said printhead substrate on another side of said ink feed slot that is opposite said one side and spaced laterally, relative to said reference axis, from said second plurality of ink drop generators, said third plurality of ink drop generators having said second predetermined center to center spacing along said reference axis;

wherein said third plurality of ink drop generators are staggered relative to said second plurality of ink drop generators along said reference axis such that said second plurality of ink drop generators and said third plurality of ink drop generators have a combined center to center spacing along said reference axis that is substantially equal to said first predetermined center to center spacing;

wherein said first plurality of ink drop generators is between said edge and said second plurality of ink drop generators; and wherein said second plurality of drop generators and said third plurality of drop generators produce yellow ink drops.

7. An ink jet printing apparatus comprising:

a printhead structure formed of a substrate, a plurality of thin film layers, an ink barrier layer and a plurality of nozzles;

a first plurality of ink drop generators defined in said printhead structure and having a first predetermined center to center spacing along a reference axis;

an ink feed slot in said substrate aligned with said reference axis;

a second plurality of ink drop generators defined in said printhead structure adjacent one side of said ink feed slot and having a second predetermined center to center spacing along said reference axis that is greater than said first predetermined center to center spacing; and a third plurality of ink drop generators defined in said printhead substrate adjacent another side of said ink feed slot that is opposite said one side and spaced laterally, relative to said reference axis, from said second plurality of ink drop generators, said third plurality of ink drop generators having said second predetermined center to center spacing along said reference axis.

8. The ink jet printing apparatus of claim 7 wherein said first plurality of ink drop generators is adjacent an edge of said printhead substrate so as to be between said edge and said second plurality of ink drop generators.

9. The ink jet printing apparatus of claim 7 wherein said third plurality of ink drop generators are staggered relative to said second plurality of ink drop generators along said reference axis such that said second plurality of ink drop generators and said third plurality of ink drop generators have a combined center to center spacing along said reference axis that is substantially equal to said first predetermined center to center spacing.

10. The ink jet printing apparatus of claim 7 wherein said first plurality of ink drop generators are adjacent an edge of said printhead substrate so as to be between said edge and said second plurality of ink drop generators.

11. The ink jet printing apparatus of claim 7 wherein said second plurality of ink drop generators and said third plurality of ink drop generators produce yellow ink drops.

* * * * *